US007287525B2

(12) United States Patent
Taglialatela-Scafati et al.

(10) Patent No.: US 7,287,525 B2
(45) Date of Patent: Oct. 30, 2007

(54) METHOD OF FEEDFORWARD CONTROLLING A MULTI-CYLINDER INTERNAL COMBUSTION ENGINE AND ASSOCIATED FEEDFORWARD FUEL INJECTION CONTROL SYSTEM

(75) Inventors: Ferdinando Taglialatela-Scafati, Giugliano (IT); Nicola Cesario, Casalnuovo di Napoli (IT); Francesco Carpentieri, San Giorgio del Sannio (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 11/367,736

(22) Filed: Mar. 3, 2006

(65) Prior Publication Data

US 2006/0235604 A1 Oct. 19, 2006

(30) Foreign Application Priority Data

Mar. 4, 2005 (EP) ..... 05425121
Mar. 1, 2006 (EP) ..... 06110560

(51) Int. Cl.
*F02D 41/34* (2006.01)

(52) U.S. Cl. ..... 123/673

(58) Field of Classification Search ..... 123/673, 123/704

See application file for complete search history.

(56) References Cited

U.S. PATENT DOCUMENTS 6,382,198 B1 * 5/2002 Smith et al. ..... 123/673
6,708,681 B2 * 3/2004 Hosoya et al. ..... 123/681

FOREIGN PATENT DOCUMENTS

| | | |
|---|---|---|
| DE | 19653521 | 6/1998 |
| DE | 19835019 | 2/2000 |
| EP | 0589517 | 3/1994 |
| GB | 2397137 | 7/2004 |
| JP | 59221433 | 12/1984 |
| WO | WO2004/048761 | 6/2004 |

OTHER PUBLICATIONS

"Cylinder Air/Fuel Ratio Estimation Using Net Heat Release Data", Tunestal et al; IFAC Workshop on Advances in Automotive Control, Mar. 28, 2001, pp. 239-247, XP001032740.

"Cylinder Air/Fuel Ratio Estimation Using Net Heat Release Data", Tunestal et al; Control Engineering Practice, Pergamon Press, Oxford, GB, vol. 11, No. 3, 2003, pp. 311-318, XP001157572, ISSN: 0967-0661.

Patent Abstracts of Japan, vol. 2000, No. 25, Apr. 12, 2001 & JP 2001234798, Aug. 31, 2001.

* cited by examiner

*Primary Examiner*—Erick Solis
(74) *Attorney, Agent, or Firm*—Lisa K. Jorgenson; Allen, Dyer, Doppelt, Milbrath & Gilchrist, P.A.

(57) ABSTRACT

The amount of fuel to be injected in each cylinder of a multi-cylinder spark ignition internal combustion engine may be determined with enhanced precision if the fuel injection durations are determined as a function of the sensed mass air flow in all the cylinders of the engine, instead of considering only the air flow in the same cylinder. This finding has led to the realization of a more efficient approach of controlling a multi-cylinder spark ignition internal combustion engine and a feedforward control system.

7 Claims, 2 Drawing Sheets

METHOD OF FEEDFORWARD CONTROLLING A MULTI-CYLINDER INTERNAL COMBUSTION ENGINE AND ASSOCIATED FEEDFORWARD FUEL INJECTION CONTROL SYSTEM

FIELD OF THE INVENTION

This invention relates to internal combustion engines, and, more particularly, to a method and associated control system for determining the duration of the fuel injection pulse in each cylinder of a multi-cylinder internal combustion engine.

BACKGROUND OF THE INVENTION

In the feedforward part of an SI (Spark Ignition) engine Air/Fuel control system, the in-cylinder mass air flow rate should be accurately estimated in order to determine the amount of fuel to be injected. Generally, this evaluation is performed either with a dedicated physical sensor (MAF sensor) or more often through an indirect evaluation.

To meet strict emission regulations, automobile gasoline engines are equipped with a three-way catalytic converter (TWC). A precise control of the air-fuel ratio (A/F) to maintain it as close as possible to the stoichiometric value is necessary to achieve a high efficiency of the TWC converter in the conversion of the toxic exhaust gases (CO, NOx, HC) into less harmful products ($CO_2$, $H_2O$, $N_2$). Typically, in a spark-ignition engine, this control is performed through a so-called lambda sensor. The lambda sensor generates a signal representative of the value of the ratio $$\lambda = \frac{\text{Air/Fuel}}{\text{Air}/Fuel_{stoichiometric}}$$

from the amount of oxygen detected in the exhaust gas mixture. If $\lambda<1$ the mixture is rich of fuel, while if $\lambda>1$ the mixture is lean of fuel.

To keep the air/fuel ratio (AFR) as close as possible to unity, the lambda sensor is introduced in the conduit or stream of exhaust gases for monitoring the amount of oxygen present in the exhaust gas mixture. The signal generated by the lambda sensor is input to the controller of the engine that adjusts the injection times and thus the fuel injected during each cycle for reaching the condition $\lambda=1$.

Traditional Air/Fuel control systems include a feed-forward part, in which the amount of fuel to be injected is calculated on the basis of the in-cylinder mass air flow, and a feedback part that uses the signal of the oxygen sensor (lambda sensor) in the exhaust gas stream, to ensure that the Air/Fuel remain as close as possible to the stoichiometric value (e.g. Heywood, J.B., -"Internal combustion engine fundamentals"-McGraw-Hill Book Co., 1988.).

FIG. 1 shows a block diagram of a traditional Air/Fuel control system. Generally, the feedback part of the Air/Fuel control system is fully active only in steady-state conditions. Moreover, the lambda sensor signal is made available only after this sensor has reached a certain operating temperature. In transients and under cold start conditions, the feedback control is disabled, thus the feedforward part of Air/Fuel control becomes particularly important.

As mentioned above, air flow estimation is often the basis for calculating the amount of injected fuel in the feedforward part of Air/Fuel control system.

A conventional technique for estimating a cylinder intake air flow in a SI (Spark Ignition) engine involves the so-called "speed-density" equation:

$$\dot{m}_{ap} = \eta(p_m, N) \cdot \frac{V_d \cdot N \cdot p_a}{120 \cdot R \cdot T_m}$$

where $\dot{m}_{ap}$ is the inlet mass air flow rate, $V_d$ is the engine displacement and N is the engine speed; $T_m$ and $p_m$ are the average manifold temperature and pressure and $\eta$ is the volumetric efficiency of the engine. This is a nonlinear function of engine speed (N) and manifold pressure ($p_m$), that may be experimentally mapped in correspondence with different engine working points.

A standard method is to map the volumetric efficiency and compensate it for density variations in the intake manifold.

One of the drawbacks in using the "speed-density" equation for the in-cylinder air flow estimation is the uncertainty in the volumetric efficiency. Generally, the volumetric efficiency is calculated in the calibration phase with the engine under steady state conditions. However variations in the volumetric efficiency due, for example, to engine aging and wear, combustion chamber deposit buildup etc., may introduce errors in the air flow estimation.

The low-pass characteristic of commercial sensors (Manifold Absolute Pressure or MAP sensors) used for the determination of the manifold pressure $p_m$, introduces a delay that, during fast transients, causes significant errors in the air flow determination.

This problem is not solved by using a faster sensor because in this case the sensor detects also pressure fluctuations due to the valve and piston motion (e.g. Barbarisi, et al., "An Extended kalman Observer for the In-Cylinder Air Mass Flow Estimation", MECA02 International Workshop on Diagnostics in Automotive Engines and Vehicles, 2001).

In engines equipped with an EGR (Exhaust Gas Recirculation) valve, the MAP (Manifold Absolute Pressure) sensor cannot distinguish between fresh air (of known oxygen content) and inert exhaust gas in the intake manifold. Therefore, in this case the speed-density equation (1) cannot be used and the air charge estimation algorithm should provide a method for separating the contribution of recycled exhaust gas to the total pressure in the intake manifold (e.g. Jankovic, M., Magner, S.W., "Air Charge Estimation and Prediction in Spark Ignition Internal Combustion Engines", Proceedings of the American Conference, San Diego, California, June 1999).

An alternative method for the air charge determination is to use a dedicated Mass Air Flow (MAF) physical sensor, located upstream the throttle, that directly measures the inlet mass air flow. The main advantages of a direct air flow measurement are: automatic compensation for engine aging and for all other factors that modify engine volumetric efficiency; improved idling stability; and lack of sensibility of the system to EGR (Exhaust Gas Recirculation) since only the fresh air flow is measured.

Anyway, air flow measurement by means of a MAF sensor (which is generally a hot wire anemometer) accurately estimates the mass flow in the cylinder only in steady state because during transients the intake manifold filling/empting dynamics play a significant role (e.g. Grizzle, J.W., Cookyand, J.A., and Milam, W.P., "Improved Cylinder Air Charge Estimation for Transient Air Fuel Ratio Control", Proceedings of American Control Conference, 1994; and Stotsky, I., Kolmanovsky, A., "Application of input estimation and control in automotive engines" Control Engineering Practice 10, pp. 1371-1383, 2002).

Moreover, for commercial automotive applications, the fact that a MAF sensor has a relatively high cost compared to the cost of MAP (Manifold Absolute Pressure) sensor used with the "speed density" evaluation approach, should be taken into account.

SUMMARY OF THE INVENTION

Test carried out by the applicants have unexpectedly shown that the amount of fuel to be injected in each cylinder of a multi-cylinder spark ignition internal combustion engine may be determined with enhanced precision if the fuel injection durations are determined as a function of the sensed mass air flow in all the cylinders of the engine, instead of considering only the air flow in the same cylinder.

This surprising finding has led the applicants to devise a more efficient method of controlling a multi-cylinder spark ignition internal combustion engine and an innovative feedforward control system.

The feedforward control system may be embodied in a feedforward-and-feedback control system of a multi-cylinder spark ignition engine, including a lambda sensor, that effectively keeps the composition of the air/fuel ratio of the mixture that is injected into the combustion chamber of each cylinder at a pre-established value.

Experimental tests carried out by the applicants demonstrated that the feedforward-and-feedback control system of this invention is effective in controlling the engine such to keep the lambda value as close as possible to any pre-established reference value.

BRIEF DESCRIPTION OF THE DRAWINGS

Preferred embodiments of the invention will be described referring to the attached drawings, wherein.

DETAILED DESCRIPTION OF THE PREFERRED EMBODIMENTS

Figure 3:
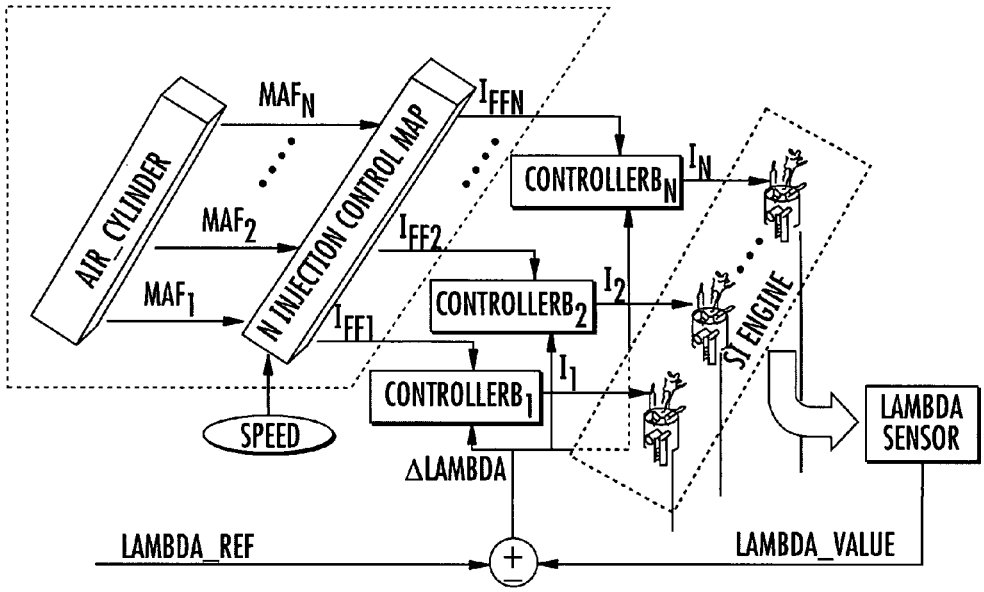
FIG. 3 is a schematic diagram illustrating an injection control system of the present invention for an internal combustion engine with N cylinders.

The amount of fuel to be injected in each cylinder of a spark ignition (SI) internal combustion engine having N cylinders is determined by a feedforward fuel injection control system as that surrounded by the broken line perimeter in FIG. 3.

The block AIR-CYLINDER generates signals $MAF_1, \ldots, MAF_N$ representative of the Mass Air Flow aspired by each cylinder of the engine. This block may be easily realized by juxtaposing N mass air flow sensors.

The block INJECTION CONTROL MAPS has as inputs the signals $MAF_1, \ldots, MAF_N$ and a signal representing the speed of the engine, and generates as a function thereof a feedforward signal $I_{FF1}, \ldots, I_{FFN}$ for each cylinder.

According to an innovative aspect of this invention, each feedforward signal is determined as a function of the speed of the engine and of all the Mass Air Flow values $MAF_1, \ldots, MAF_N$ of all the cylinders. The feedforward signals $I_{FF1}, \ldots, I_{FFN}$ are generated in this case by pointing to respective locations of a look-up table that is established during a test phase of the engine.

Tests carried out by the applicants have demonstrated that generating each feedforward signal $I_{FFi}$ for a certain cylinder as a function of all the mass air flow values detected or estimated for all the cylinders of the engine, enhances the apparent correctness of the composition of the air/fuel mixture that is injected into each cylinder of the engine.

This unpredictable result may be explained by the fact that there is an apparent non-homogeneous air filling for the different cylinders of the engine. This phenomenon is induced by air backflow in the intake manifold and air turbulences. For this reason, even if each cylinder of the engine is maintained nominally to the stoichiometric condition, the global exhaust gas could not have the oxygen content needed to guarantee the maximum efficiency of the three-way catalytic converter. For this reason, it appears that the injected fuel amount for each cylinder of the engine should be dependent not only by the related mass air flow value but also by the mass air flow incoming into the other cylinders.

According to a preferred embodiment of this invention, the amount of fuel to be injected in each cylinder of an internal combustion engine having N cylinders is determined with a feedforward-and-feedback fuel injection control system as depicted in FIG. 3.

A lambda sensor, introduced in the outlet conduit of exhaust gases for monitoring the amount of oxygen in the exhaust gases, determines whether the lambda ratio is above or below unity from the amount of oxygen detected in the exhaust gas mixture. The lambda sensor provides a signal representative of the value of the ratio:

$$\lambda = \frac{\text{Air/Fuel}}{\text{Air}/Fuel_{stoichiometric}}$$

If $\lambda<1$ the mixture is rich of fuel, while if $\lambda>1$ the mixture is lean of fuel.

The feedback-and-feedforward control system comprises an array of controllers $CONTROLLERB_1, \ldots, CONTROLLERB_N$ each input with a respective feedforward signal $I_{FFi}$ and with an error signal $\Delta$LAMBDA representing the difference between the actual lambda ratio LAMBDA-VALUE and a reference value LAMBDA-REF. Each controller adjusts the injection duration $I_1, \ldots, I_N$ of a respective cylinder and thus the amount of fuel that is injected during each cycle in the respective cylinder for eventually reach the condition LAMBDA-VALUE=LAMBDA-REF.

LAMBDA-VALUE=LAMBDA-REF. The lambda sensor may be preferably a virtual lambda sensor of the type described in the cited prior European Patent application No. 05,425,121.0.

According to a preferred embodiment of this invention, each controller $CONTROLLERB_i$ is realized using a Fuzzy Inference System properly set in a preliminary calibration phase of the system, according to a common practice.

Figure 2:
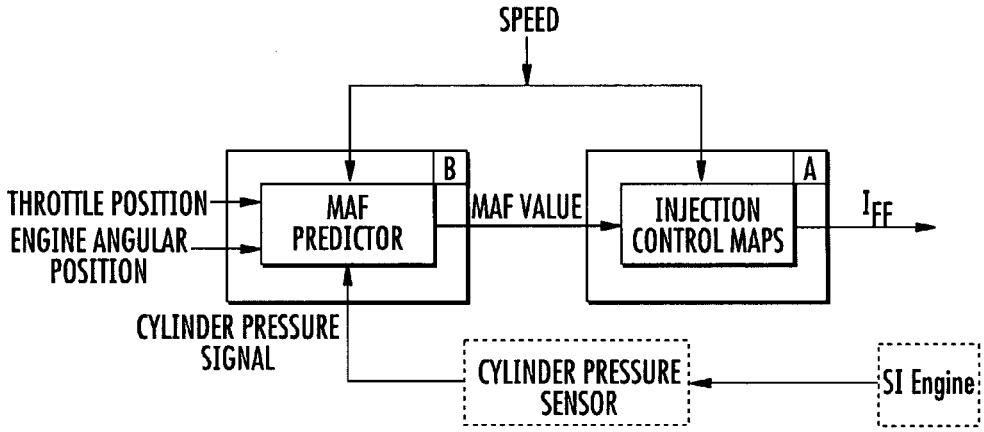
FIG. 2 is a block diagram illustrating a feedforward injection control system in accordance with the present invention.

Preferably, each mass air flow sensor is a soft-computing mass air flow estimator, of the type disclosed in the European patent application No. 06,110,557.3 in the name of the same applicants and shown in FIG. 2. This estimator is capable of estimating both in a steady state and in transient conditions the in-cylinder mass air flow of a single-cylinder SI engine, basically using a combustion pressure signal of the cylinder. A learning machine, such as for example a MLP (Multi-Layer Perceptron) neural network, trained on the experimental data acquired in different operating conditions of a gasoline engine, may be used for realizing the inlet mass air flow estimator.

A traditional combustion pressure piezoelectric transducer, or any other low-cost pressure sensor, may provide the required raw information. As disclosed in the cited European Patent application, the cylinder combustion pressure is correlated with the inlet mass air flow of the cylinder, thus a signal produced by a combustion pressure sensor is exploited for producing through a soft-computing processing that utilizes information on throttle opening, speed and angular position, a signal representative of the inlet mass air flow.

REFERENCES

1. Heywood, J. B.,—"Internal combustion engine fundamentals"—McGraw-Hill Book Co., 1988.
2. Barbarisi, O., Di Gaeta, A., Glielmo, L., and Santini, S., "An Extended Kalman Observer for the In-Cylinder Air Mass Flow Estimation", MECA02 International Workshop on Diagnostics in Automotive Engines and Vehicles, 2001.
3. Grizzle, J. W., Cookyand, J. A., and Milam, W. P., "Improved Cylinder Air Charge Estimation for Transient Air Fuel Ratio Control", Proceedings of American Control Conference, 1994.
4. Jankovic, M., Magner, S. W., "Air Charge Estimation and Prediction in Spark Ignition Internal Combustion Engines", Proceedings of the American Conference, San Diego, Calif., June 1999.
5. Stotsky, I., Kolmanovsky, A., "Application of input estimation and control in automotive engines" Control Engineering Practice 10, pp. 1371–1383, 2002.

That which is claimed is:

1. A feedforward control system of a multi-cylinder internal combustion engine generating feedforward signals representing durations of fuel injection ($I_{FF}$) of each cylinder of the engine, comprising:

a plurality of mass air flow physical sensors or estimators each generating a mass air flow signal representative of the intake mass air flow of a respective cylinder of said engine; and a single logic unit input with all said mass air flow signals, generating said feedforward signals the level of which corresponds to the level established by a look-up table stored therein in correspondence of the current speed of the engine and of the current values of all said mass air flow signals.

2. The feedforward-and-feedback control system of claim 1 further comprising:

a lambda sensor generating a signal representing the air/fuel ratio of said engine; and a plurality of feedback controllers, one for each cylinder, each generating a fuel injection control signal of a respective cylinder of said engine as a function of the difference between the signal output by the lambda sensor and a reference value to nullify said difference.

3. The feedforward control system of claim 2, wherein each of said controllers comprises a Fuzzy Inference System set in a calibration phase of the system.

4. The feedforward control system of claim 1, wherein each of said mass air flow sensors is an estimator of inlet air flow in a combustion chamber of a cylinder of an internal combustion engine, comprising:

a pressure sensor generating a pressure signal of the pressure in at least said combustion chamber of a cylinder of the engine; and an off-line trained learning machine realized with soft-computing techniques and input at least with said cylinder pressure signal, generating a signal representative of the inlet air flow in said combustion chamber of said engine as a function of characteristic parameters thereof and of said characteristic parameters of the pressure signal.

5. A method of feedforward controlling a multi-cylinder internal combustion engine by generating feedforward signals representing durations of fuel injection of each cylinder of the engine, comprising:

generating mass air flow signals representative of the estimated inlet air flow of each cylinder of said engine; and generating said feedforward signals the level of which corresponds to the level established by a look-up table in correspondence of the current speed of the engine and of the current values of all said mass air flow signals.

6. The method of claim 5, wherein each of said mass air flow signals is generated by:

preliminarily, providing a learning machine realized with soft-computing techniques for generating an output signal as a function of at least an input signal;

training said learning machine for reproducing the functioning of a mass air flow physical sensor;

sensing the pressure in a combustion chamber of a respective cylinder of the engine, generating a respective cylinder pressure signal;

extracting characteristic parameters of said pressure signal; and generating each of said signals representative of the inlet air flow as a function of said characteristic parameters using said trained learning machine.

7. The method of claim 6, wherein said learning machine is input with signals representing the position of a throttle of the engine, the speed of the engine, the angular position of the drive shaft of the engine and with said cylinder pressure signal.

* * * * *

UNITED STATES PATENT AND TRADEMARK OFFICE

CERTIFICATE OF CORRECTION

PATENT NO. : 7,287,525 B2
APPLICATION NO. : 11/367736
DATED : October 30, 2007
INVENTOR(S) : Taglialatela-Scafati et al.

It is certified that error appears in the above-identified patent and that said Letters Patent is hereby corrected as shown below:

Please delete column 1 line 1 through column 6 line 55 and insert column 1 line 1 through column 8 line 15 as attached Signed and Sealed this Thirteenth Day of October, 2009

David J. Kappos

David J. Kappos
*Director of the United States Patent and Trademark Office*

METHOD OF FEEDFORWARD CONTROLLING A MULTI-CYLINDER INTERNAL COMBUSTION ENGINE AND ASSOCIATED FEEDFORWARD FUEL INJECTION CONTROL SYSTEM

FIELD OF THE INVENTION

This invention relates to internal combustion engines, and, more particularly, to a method and associated control system for determining the duration of the fuel injection pulse in each cylinder of a multi-cylinder internal combustion engine.

BACKGROUND OF THE INVENTION

In the feedforward part of an SI (Spark Ignition) engine Air/Fuel control system, the in-cylinder mass air flow rate should be accurately estimated in order to determine the amount of fuel to be injected. Generally, this evaluation is performed either with a dedicated physical sensor (MAF sensor) or more often through an indirect evaluation.

To meet strict emission regulations, automobile gasoline engines are equipped with a three-way catalytic converter (TWC). A precise control of the air-fuel ratio (A/F) to maintain it as close as possible to the stoichiometric value is necessary to achieve a high efficiency of the TWC converter in the conversion of the toxic exhaust gases (CO, NOx, HC) into less harmful products ($CO_2$, $H_2O$, $N_2$). Typically, in a spark-ignition engine, this control is performed through a so-called lambda sensor. The lambda sensor generates a signal representative of the value of the ratio $$\lambda = \frac{\text{Air/Fuel}}{\text{Air/Fuel}_{stoichiometric}}$$

from the amount of oxygen detected in the exhaust gas mixture. If $\lambda<1$ the mixture is rich of fuel, while if $\lambda>1$ the mixture is lean of fuel.

To keep the air/fuel ratio (AFR) as close as possible to unity, the lambda sensor is introduced in the conduit or stream of exhaust gases for monitoring the amount of oxygen present in the exhaust gas mixture. The signal generated by the lambda sensor is input to the controller of the engine that adjusts the injection times and thus the fuel injected during each cycle for reaching the condition $\lambda=1$.

Traditional Air/Fuel control systems include a feed-forward part, in which the amount of fuel to be injected is calculated on the basis of the in-cylinder mass air flow, and a feedback part that uses the signal of the oxygen sensor (lambda sensor) in the exhaust gas stream, to ensure that the Air/Fuel remain as close as possible to the stoichiometric value (e.g. Heywood, J.B., -"Internal combustion engine fundamentals"-McGraw-Hill Book Co., 1988.).

Figure 1:
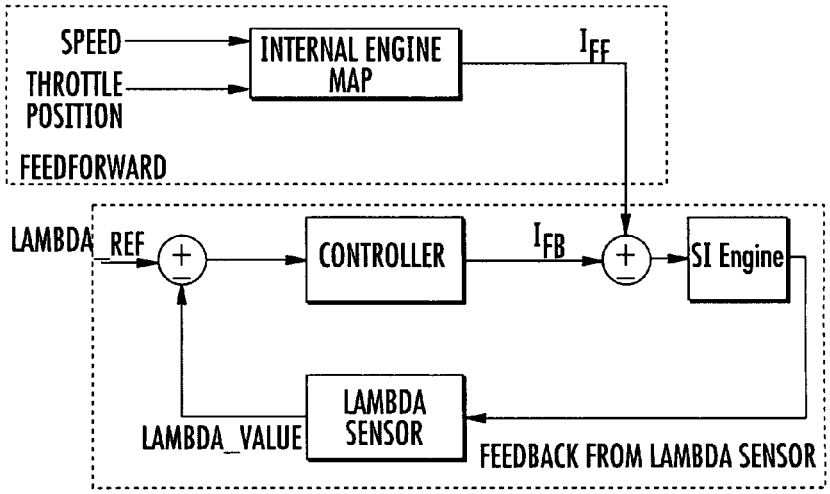
FIG. 1 (PRIOR ART)
FIG. 1 is a block diagram illustrating a conventional air/fuel control system for an internal combustion engine as in the prior art.

FIG. 1 shows a block diagram of a traditional Air/Fuel control system. Generally, the feedback part of the Air/Fuel control system is fully active only in steady-state conditions. Moreover, the lambda sensor signal is made available only after this sensor has reached a certain operating temperature. In transients and under cold start conditions, the feedback control is disabled, thus the feedforward part of Air/Fuel control becomes particularly important.

As mentioned above, air flow estimation is often the basis for calculating the amount of injected fuel in the feedforward part of Air/Fuel control system. A conventional technique for estimating a cylinder intake air flow in a SI (Spark Ignition) engine involves the so-called "speed-density" equation:

$$\dot{m}_{ap} = \eta\,(p_m, N)\cdot\frac{V_d\cdot N\cdot p_a}{120\cdot R\cdot T_m}$$

where $\dot{m}_{ap}$ is the inlet mass air flow rate, $V_d$ is the engine displacement and N is the engine speed; $T_m$ and $p_m$ are the average manifold temperature and pressure and $\eta$ is the volumetric efficiency of the engine. This is a nonlinear function of engine speed (N) and manifold pressure ($p_m$), that may be experimentally mapped in correspondence with different engine working points.

A standard method is to map the volumetric efficiency and compensate it for density variations in the intake manifold. One of the drawbacks in using the "speed-density" equation for the in-cylinder air flow estimation is the uncertainty in the volumetric efficiency. Generally, the volumetric efficiency is calculated in the calibration phase with the engine under steady state conditions. However variations in the volumetric efficiency due, for example, to engine aging and wear, combustion chamber deposit buildup etc., may introduce errors in the air flow estimation.

The low-pass characteristic of commercial sensors (Manifold Absolute Pressure or MAP sensors) used for the determination of the manifold pressure $p_m$, introduces a delay that, during fast transients, causes significant errors in the air flow determination.

This problem is not solved by using a faster sensor because in this case the sensor detects also pressure fluctuations due to the valve and piston motion (e.g. Barbarisi, et al., "An Extended Kalman Observer for the In-Cylinder Air Mass Flow Estimation", MECA02 International Workshop on Diagnostics in Automotive Engines and Vehicles, 2001).

In engines equipped with an EGR (Exhaust Gas Recirculation) valve, the MAP (Manifold Absolute Pressure) sensor cannot distinguish between fresh air (of known oxygen content) and inert exhaust gas in the intake manifold. Therefore, in this case the speed-density equation cannot be used and the air charge estimation algorithm should provide a method for separating the contribution of recycled exhaust gas to the total pressure in the intake manifold (e.g. Jankovic, M., Magner, S.W., "Air Charge Estimation and Prediction in Spark Ignition Internal Combustion Engines", Proceedings of the American Conference, San Diego, Calif., June 1999).

An alternative method for the air charge determination is to use a dedicated Mass Air Flow (MAF) physical sensor, located upstream the throttle, that directly measures the inlet mass air flow. The main advantages of a direct air flow measurement are: automatic compensation for engine aging and for all other factors that modify engine volumetric efficiency; improved idling stability; and lack of sensibility of the system to EGR (Exhaust Gas Recirculation) since only the fresh air flow is measured.

Anyway, air flow measurement via a MAF sensor (which is generally a hot wire anemometer) accurately estimates the mass flow in the cylinder only in steady state because during transients the intake manifold filling/emptying dynamics play a significant role (e.g. Grizzle, J.W., Cookyand, J.A., and Milam, W.P., "Improved Cylinder Air Charge Estimation for Transient Air Fuel Ratio Control", Proceedings of American Control Conference, 1994; and Stotsky, I., Kolmanovsky, A., "Application of input estimation and control in automotive engines" Control Engineering Practice 10, pp. 1371-1383, 2002).

Moreover, for commercial automotive applications, the fact that a MAF sensor has a relatively high cost compared to the cost of a MAP (Manifold Absolute Pressure) sensor used with the "speed density" evaluation approach, should be taken into account.

SUMMARY OF THE INVENTION

Tests carried out by the applicants have unexpectedly shown that the amount of fuel to be injected in each cylinder of a multi-cylinder spark ignition internal combustion engine may be determined with enhanced precision if the fuel injection durations are determined as a function of the sensed mass air flow in all the cylinders of the engine, instead of considering only the air flow in the same cylinder.

This surprising finding has led the applicants to devise a more efficient method of controlling a multi-cylinder spark ignition internal combustion engine and an innovative feedforward control system.

The feedforward control system may be embodied in a feedforward-and-feedback control system of a multi-cylinder spark ignition engine, including a lambda sensor, that effectively keeps the composition of the air/fuel ratio of the mixture that is injected into the combustion chamber of each cylinder at a pre-established value.

Experimental tests carried out by the applicants demonstrated that the feedforward-and-feedback control system of this invention is effective in controlling the engine such to keep the lambda value as close as possible to any pre-established reference value.

BRIEF DESCRIPTION OF THE DRAWINGS

Preferred embodiments of the invention will be described referring to the attached drawings, wherein:

FIG. 1 is a block diagram illustrating a conventional air/fuel control system for an internal combustion engine as in the prior art;

FIG. 2 is a block diagram illustrating a feedforward injection control system in accordance with the present invention; and FIG. 3 is a schematic diagram illustrating an injection control system of the present invention for an internal combustion engine with N cylinders.

DETAILED DESCRIPTION OF THE PREFERRED EMBODIMENTS

The amount of fuel to be injected in each cylinder of a spark ignition (SI) internal combustion engine having N cylinders is determined by a feedforward fuel injection control system as that surrounded by the broken line perimeter in FIG. 3. The block AIR-CYLINDER generates signals $MAF_1, \ldots, MAF_N$ representative of the Mass Air Flow aspired by each cylinder of the engine. This block may be easily realized by juxtaposing N mass air flow sensors. The block INJECTION CONTROL MAPS has as inputs the signals $MAF_1, \ldots, MAF_N$ and a signal representing the speed of the engine, and generates as a function thereof a feedforward signal $I_{FF1}, \ldots, I_{FFN}$ for each cylinder.

According to an innovative aspect of this invention, each feedforward signal is determined as a function of the speed of the engine and of all the Mass Air Flow values $MAF_1, \ldots, MAF_N$ of all the cylinders. The feedforward signals $I_{FF1}, \ldots, I_{FFN}$ are generated in this case by pointing to respective locations of a look-up table that is established during a test phase of the engine.

Tests carried out by the applicants have demonstrated that generating each feedforward signal $I_{FFi}$ for a certain cylinder as a function of all the mass air flow values detected or estimated for all the cylinders of the engine, enhances the apparent correctness of the composition of the air/fuel mixture that is injected into each cylinder of the engine. This unpredictable result may be explained by the fact that there is an apparent non-homogeneous air filling for the different cylinders of the engine. This phenomenon is induced by air backflow in the intake manifold and air turbulences. For this reason, even if each cylinder of the engine is maintained nominally to the stoichiometric condition, the global exhaust gas could not have the oxygen content needed to guarantee the maximum efficiency of the three-way catalytic converter. For this reason, it appears that the injected fuel amount for each cylinder of the engine should be dependent not only by the related mass air flow value but also by the mass air flow incoming into the other cylinders.

According to a preferred embodiment of this invention, the amount of fuel to be injected in each cylinder of an internal combustion engine having N cylinders is determined with a feedforward-and-feedback fuel injection control system as depicted in FIG. 3.

A lambda sensor, introduced in the outlet conduit of exhaust gases for monitoring the amount of oxygen in the exhaust gases, determines whether the lambda ratio is above or below unity from the amount of oxygen detected in the exhaust gas mixture. The lambda sensor provides a signal representative of the value of the ratio:

$$\lambda = \frac{\text{Air/Fuel}}{\text{Air/Fuel}_{stoichiometric}}$$

If $\lambda<1$ the mixture is rich of fuel, while if $\lambda>1$ the mixture is lean of fuel.

The feedback-and-feedforward control system comprises an array of controllers $CONTROLLERB_1, \ldots, CONTROLLERB_N$ each input with a respective feedforward signal $I_{FFi}$ and with an error signal $\Delta_{LAMBDA}$ representing the difference between the actual lambda ratio LAMBDA-VALUE and a reference value LAMBDA-REF. Each controller adjusts the injection duration $I_1, \ldots, I_N$ of a respective cylinder and thus the amount of fuel that is injected during each cycle in the respective cylinder for eventually reach the condition LAMBDA-VALUE=LAMBDA-REF. The lambda sensor may be preferably a virtual lambda sensor of the type described in the cited prior European Patent application No. 05,425,121.0.

According to a preferred embodiment of this invention, each controller $CONTROLLERB_i$ is realized using a Fuzzy Inference System properly set in a preliminary calibration phase of the system, according to a common practice. Preferably, each mass air flow sensor is a soft-computing mass air flow estimator, of the type disclosed in the European patent application No. 06,110,557.3 in the name of the same applicants and shown in FIG. 2. This estimator is capable of estimating both in a steady state and in transient conditions the in-cylinder mass air flow of a single-cylinder SI engine, basically using a combustion pressure signal of the cylinder. A learning machine, such as for example a MLP (Multi-Layer Perceptron) neural network, trained on the experimental data acquired in different operating conditions of a gasoline engine, may be used for realizing the inlet mass air flow estimator.

A traditional combustion pressure piezoelectric transducer, or any other low-cost pressure sensor, may provide the required raw information. As disclosed in the cited European Patent application, the cylinder combustion pressure is correlated with the inlet mass air flow of the cylinder, thus a signal produced by a combustion pressure sensor is exploited for producing through a soft-computing processing that utilizes information on throttle opening, speed and angular position, a signal representative of the inlet mass air flow.

REFERENCES

1. Heywood, J. B.,—"Internal combustion engine fundamentals"—McGraw-Hill Book Co., 1988.
2. Barbarisi, O., Di Gaeta, A., Glielmo, L., and Santini, S., "An Extended Kalman Observer for the In-Cylinder Air Mass Flow Estimation", MECA02 International Workshop on Diagnostics in Automotive Engines and Vehicles, 2001.
3. Grizzle, J. W., Cookyand, J. A., and Milam, W. P., "Improved Cylinder Air Charge Estimation for Transient Air Fuel Ratio Control", Proceedings of American Control Conference, 1994.
4. Jankovic, M., Magner, S. W., "Air Charge Estimation and Prediction in Spark Ignition Internal Combustion Engines", Proceedings of the American Conference, San Diego, Calif., June 1999.
5. Stotsky, I., Kolmanovsky, A., "Application of input estimation and control in automotive engines" Control Engineering Practice 10, pp. 1371–1383, 2002.

That which is claimed is:

1. A feedforward control system of a multi-cylinder internal combustion engine generating feedforward signals representing durations of fuel injection of each cylinder of the engine, comprising:

a plurality of mass air flow physical sensors or estimators each generating a mass air flow signal representative of the intake mass air flow of a respective cylinder of said engine; and a single logic unit input with all said mass air flow signals generating said feedforward signals the level of which corresponds to the level established by a look-up table stored therein in correspondence of the current speed of the engine and of the current values of all said mass air flow signals.

2. The feedforward control system of claim 1 further comprising:

a lambda sensor generating a signal representing the air/fuel ratio of said engine; and a plurality of feedback controllers, one for each cylinder, each generating a fuel injection control signal of a respective cylinder of said engine as a function of the difference between the signal output by the lambda sensor and a reference value to nullify said difference.

3. The feedforward control system of claim 2, wherein each of said controllers comprises a Fuzzy Inference System set in a calibration phase of the system.

4. The feedforward control system of claim 1, wherein each of said mass air flow sensors is an estimator of inlet air flow in a combustion chamber of a cylinder of an internal combustion engine, comprising:

a pressure sensor generating a pressure signal of the pressure in at least said combustion chamber of a cylinder of the engine; and an off-line trained learning machine realized with soft-computing techniques and input at least with said cylinder pressure signal, generating a signal representative of the inlet air flow in said combustion chamber of said engine as a function of characteristic parameters thereof and of said characteristic parameters of the pressure signal.

5. A method of feedforward controlling a multi-cylinder internal combustion engine by generating feedforward signals representing durations of fuel injection of each cylinder of the engine, comprising:

generating mass air flow signals representative of the estimated inlet air flow of each cylinder of said engine; and generating said feedforward signals the level of which corresponds to the level established by a look-up table in correspondence of the current speed of the engine and of the current values of all said mass air flow signals.

6. The method of claim 5, wherein each of said mass air flow signals is generated by:

preliminarily, providing a learning machine realized with soft-computing techniques for generating an output signal as a function of at least an input signal;

training said learning machine for reproducing the functioning of a mass air flow physical sensor;

sensing the pressure in a combustion chamber of a respective cylinder of the engine, generating a respective cylinder pressure signal;

extracting characteristic parameters of said pressure signal; and generating each of said signals representative of the inlet air flow as a function of said characteristic parameters using said trained learning machine.

7. The method of claim 6, wherein said learning machine is input with signals representing the position of a throttle of the engine, the speed of the engine, the angular position of the drive shaft of the engine and with said cylinder pressure signal.

8. A feedforward control system of a multi-cylinder internal combustion engine generating feedforward signals representing durations of fuel injection of each cylinder of the engine, the system comprising:

a plurality of mass air flow devices each generating a mass air flow signal representative of the intake mass air flow of a respective cylinder of the engine; and a logic unit including a look-up table storing established feedforward signal levels corresponding to a speed of the engine and the mass air flow signal values, the logic unit receiving all the current mass air flow signals and generating feedforward signals based upon the stored established feedforward signal levels.

9. The feedforward control system of claim 8 further comprising:

a lambda sensor generating a signal representing the air/fuel ratio of the engine; and a plurality of feedback controllers, one for each cylinder, each generating a fuel injection control signal of a respective cylinder of the engine based upon the difference between the signal output by the lambda sensor and a reference value to reduce the difference.

10. The feedforward control system of claim 9, wherein each of said feedback controllers comprises a Fuzzy Inference System set during a system calibration phase.

11. The feedforward control system of claim 8, wherein each of said mass air flow devices comprises an estimator of inlet air flow in a combustion chamber of a cylinder of the internal combustion engine, and includes:

a pressure sensor to generate a pressure signal of the pressure in at least the combustion chamber of the cylinder of the engine; and a soft-computing learning machine input with at least the pressure signal, to generate a signal representative of the inlet air flow in the combustion chamber of the engine based upon characteristic parameters thereof and characteristic parameters of the pressure signal.

12. A method of feedforward controlling a multi-cylinder internal combustion engine by generating feedforward signals representing durations of fuel injection of each cylinder of the engine, the method comprising:

generating mass air flow signals representative of the estimated inlet air flow of each cylinder of the engine; and generating feedforward signals based upon stored feedforward signal levels which correspond to the speed of the engine and the values of all the mass air flow signals.

13. The method of claim 12, wherein each of said mass air flow signals is generated by:

providing a soft-computing learning machine to generate an output signal based upon at least an input signal;

training the learning machine to reproduce the operation of a mass air flow physical sensor;

sensing the pressure in a combustion chamber of a respective cylinder of the engine, and generating a respective cylinder pressure signal;

extracting characteristic parameters of the pressure signal; and generating each of said mass air flow signals representative of the inlet air flow based upon the characteristic parameters input to the trained soft-computing learning machine.

14. The method of claim 13, further comprising inputting, to the soft-computing learning machine, signals representing the position of a throttle of the engine, the speed of the engine, and an angular position of the drive shaft of the engine.

* * * * *